US010091583B2

(12) United States Patent
Holman

(10) Patent No.: US 10,091,583 B2
(45) Date of Patent: Oct. 2, 2018

(54) ROOM AND PROGRAM RESPONSIVE LOUDSPEAKER SYSTEM

(71) Applicant: Apple Inc., Cupertino, CA (US)

(72) Inventor: Tomlinson M. Holman, Yucca Valley, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 14/771,482

(22) PCT Filed: Mar. 6, 2014

(86) PCT No.: PCT/US2014/021424

§ 371 (c)(1),
(2) Date: Aug. 28, 2015

(87) PCT Pub. No.: WO2014/138489

PCT Pub. Date: Sep. 12, 2014

(65) Prior Publication Data

US 2016/0007116 A1 Jan. 7, 2016

Related U.S. Application Data

(60) Provisional application No. 61/774,045, filed on Mar. 7, 2013.

(51) Int. Cl.
*H04R 27/00* (2006.01)
*H04R 5/02* (2006.01)
(Continued)

(52) U.S. Cl.
CPC ..... *H04R 3/12* (2013.01); *G10K 15/08* (2013.01); *G10L 25/78* (2013.01); *H04R 1/403* (2013.01); *H04R 29/002* (2013.01); *H04S 7/305* (2013.01)

(58) Field of Classification Search
CPC . H04S 7/305; H04S 7/30; H04S 7/302; H04S 7/303; H04R 3/04; G10K 11/34;
(Continued)

(56) References Cited

U.S. PATENT DOCUMENTS 5,812,674 A 9/1998 Jot et al.
7,881,479 B2 2/2011 Asada
(Continued)

FOREIGN PATENT DOCUMENTS

CN 1906972 1/2007
CN 101874414 10/2010
(Continued)

OTHER PUBLICATIONS

PCT International Search Report and Written Opinion for PCT International Appln No. PCT/US2014/021424 filed on Mar. 6, 2014 (9 pages).
(Continued)

*Primary Examiner* — George C Monikang
(74) *Attorney, Agent, or Firm* — Womble Bond Dickinson (US) LLP

(57) ABSTRACT

A home audio system that includes an audio receiver and one or more loudspeaker arrays is described. The audio receiver measures the acoustic properties of the room in which the loudspeaker arrays reside and the audio characteristics of the sound program content to be played through the loudspeaker arrays. Based on these measurements, the audio receiver assigns a directivity ratio and potentially various beam patterns to one or more segments of the sound program content. The assigned directivity ratio is used by the receiver to play the segment of the sound program content through the loudspeaker arrays. Other embodiments are also described.

23 Claims, 4 Drawing Sheets

(51) Int. Cl.

| | |
|---|---|
| ***H04R 3/12*** | (2006.01) |
| ***H04S 7/00*** | (2006.01) |
| ***G10K 15/08*** | (2006.01) |
| ***G10L 25/78*** | (2013.01) |
| ***H04R 1/40*** | (2006.01) |
| ***H04R 29/00*** | (2006.01) |

(58) Field of Classification Search
CPC ..... G01S 3/802; G01S 3/8083; G01S 5/30; G10H 2210/281; G10H 2250/531; G10H 2210/301
USPC ..... 381/59, 63, 77, 303, 309
See application file for complete search history.

(56) References Cited

U.S. PATENT DOCUMENTS

| | | | | |
|---|---|---|---|---|
| 2002/0067835 | A1 | 6/2002 | Vatter | |
| 2006/0080089 | A1* | 4/2006 | Vierthaler | G10L 21/0364 704/208 |
| 2007/0165878 | A1* | 7/2007 | Konagai | H04R 1/403 381/89 |
| 2007/0263889 | A1* | 11/2007 | Melanson | H04S 7/301 381/300 |
| 2008/0089522 | A1* | 4/2008 | Baba | H04S 7/305 381/17 |
| 2008/0285772 | A1* | 11/2008 | Haulick | G01S 7/52003 381/92 |
| 2009/0010443 | A1 | 1/2009 | Ahnert et al. | |
| 2010/0017205 | A1* | 1/2010 | Visser | G10L 21/02 704/225 |
| 2010/0150359 | A1 | 6/2010 | KnicKrehm et al. | |
| 2010/0296678 | A1* | 11/2010 | Kuhn-Rahloff | H04S 7/30 381/303 |
| 2011/0255702 | A1 | 10/2011 | Jensen | |
| 2012/0189147 | A1 | 7/2012 | Terada et al. | |

FOREIGN PATENT DOCUMENTS

| | | |
|---|---|---|
| JP | H0522798 | 1/1993 |
| JP | 2006340305 | 12/2006 |
| WO | WO-2006126473 | 11/2006 |
| WO | WO 2009/022278 A1 | 2/2009 |
| WO | WO-2009022278 | 2/2009 |

OTHER PUBLICATIONS

PCT International Preliminary Report on Patentability for PCT International Appln No. PCT/US2014/021424 dated Sep. 17, 2015 (7 pages).

Korean Office Action with English Language Translation, dated Aug. 17, 2016, Korean Application No. 10-2015-7024182.

Chu, W.T., et al., "Detailed Directivity of Sound Fields around Human Talkers", *IRC-RR-104, National Research Council Canada*, (Dec. 2002), 48.

Fujimoto, Masakiyo, et al., "Voice Activity Detection Using Frame-Wise Model Re-Estimation Method Based on Gaussian Pruning with Weight Normalization", *Interspeech 2010, NTT Communication Science Laboratories, NTT Corporation*, Makuhari, Chiba, Japan, (Sep. 26-30, 2010), 3102-3105.

Holman, Tomlinson, et al., "First Results from a Large-Scale Measurement Program for Home Theaters", *Audio Engineering Society, Convention Paper 8310*, Presented at the 129th Convention, San Francisco, CA, USA, (Nov. 4-7, 2010), 23 pages.

Holman, Tomlinson, "New Factors in Sound for Cinema and Television", *J. Audio Eng. Soc.*, vol. 39, No. 7/8, (Jul./Aug. 1991), 529-539.

Holman, Tomlinson, "Scaling the Experience", *AES 12th International Conference*, (Jun. 28-30, 1993), 232-251.

Kuhl, W., et al., "The Significance of Diffuse Sound Radiated from Loudspeakers for the Subjective 'Hearing Event'", *Acustica 40*, (Translated to English on Jul. 11, 2012 by Landon IP of Alexandria, VA), (1978), 182-191.

Japanese Office Action with English Language Translation, dated Oct. 6, 2016, Japanese Application No. 2015-561683.

European Examination Report, dated Nov. 8, 2016, European Application No. 14712960.5.

Korean Office Action, dated Apr. 25, 2017, Korean Application No. 10-2015-7024182.

Chinese Office Action with English Translation, dated Dec. 4, 2017, Chinese Application No. 201480021643.2.

Japanese Office Action with English Translation, dated Oct. 10, 2017, Japanese Application No. 2015-561683.

* cited by examiner

ROOM AND PROGRAM RESPONSIVE LOUDSPEAKER SYSTEM

RELATED MATTERS

This application is a U.S. National Phase Application under 35 U.S.C. § 371 of International Application No. PCT/US2014/021424, filed Mar. 6, 2014, which claims the benefit of the earlier filing date of U.S. provisional application No. 61/774,045, filed Mar. 7, 2013, and this application hereby incorporates herein by reference these previous patent applications.

FIELD

Audio system electronics that play program content through loudspeakers with a set of directivities that reflect the characteristics of the playback room environment, and the sound program content. Other embodiments are also described.

BACKGROUND

Loudspeakers have two primary specifications: (1) the frequency response pointed in the direction of the listener and (2) the ratio of sound launched towards the listener vs. elsewhere within the room. The first specification is known as the listening window response of the loudspeaker and the second specification is the directivity index of the loudspeaker. While a great deal of attention has traditionally been paid to the frequency response, less attention has been paid to the directivity of a loudspeaker.

SUMMARY

Rooms affect the sound of loudspeakers dramatically. Moving from one room to another can be a bigger sonic difference than changing brands and models of loudspeakers. To help overcome the room effect, loudspeaker-room equalization systems have been developed and deployed. However, another effect on the sound is the interaction between the loudspeaker's directivity and the room acoustics. This cannot be overcome with traditional steady-state based equalization.

Further, traditional steady-state based equalization is not responsive to sound program content played through the loudspeaker. In some instances elements of sound program content may benefit from a higher directivity while in other instances a lower directivity is desired.

An embodiment of the invention is a home audio system that includes an audio receiver or other source and one or more loudspeakers. The audio receiver measures the acoustic properties of the room in which the loudspeakers reside and the audio characteristics of the sound program content to be played through the loudspeakers. Based on these measurements, the audio receiver assigns a directivity ratio to one or more segments of the sound program content. The assigned directivity ratio is used by the receiver to play the segment of the sound program content through the loudspeakers. By adjusting directivity properties of the loudspeakers responsive to both the characteristics of the room and the sound program content, the audio receiver drives the loudspeakers to more accurately represent the position and depth of the sound program content to the listener.

The above summary does not include an exhaustive list of all aspects of the present invention. It is contemplated that the invention includes all systems and methods that can be practiced from all suitable combinations of the various aspects summarized above, as well as those disclosed in the Detailed Description below and particularly pointed out in the claims filed with the application. Such combinations have particular advantages not specifically recited in the above summary.

BRIEF DESCRIPTION OF THE DRAWINGS

The embodiments of the invention are illustrated by way of example and not by way of limitation in the figures of the accompanying drawings in which like references indicate similar elements. It should be noted that references to "an" or "one" embodiment of the invention in this disclosure are not necessarily to the same embodiment, and they mean at least one.

DETAILED DESCRIPTION

Several embodiments are described with reference to the appended drawings are now explained. While numerous details are set forth, it is understood that some embodiments of the invention may be practiced without these details. In other instances, well-known circuits, structures, and techniques have not been shown in detail so as not to obscure the understanding of this description.

Figure 1:
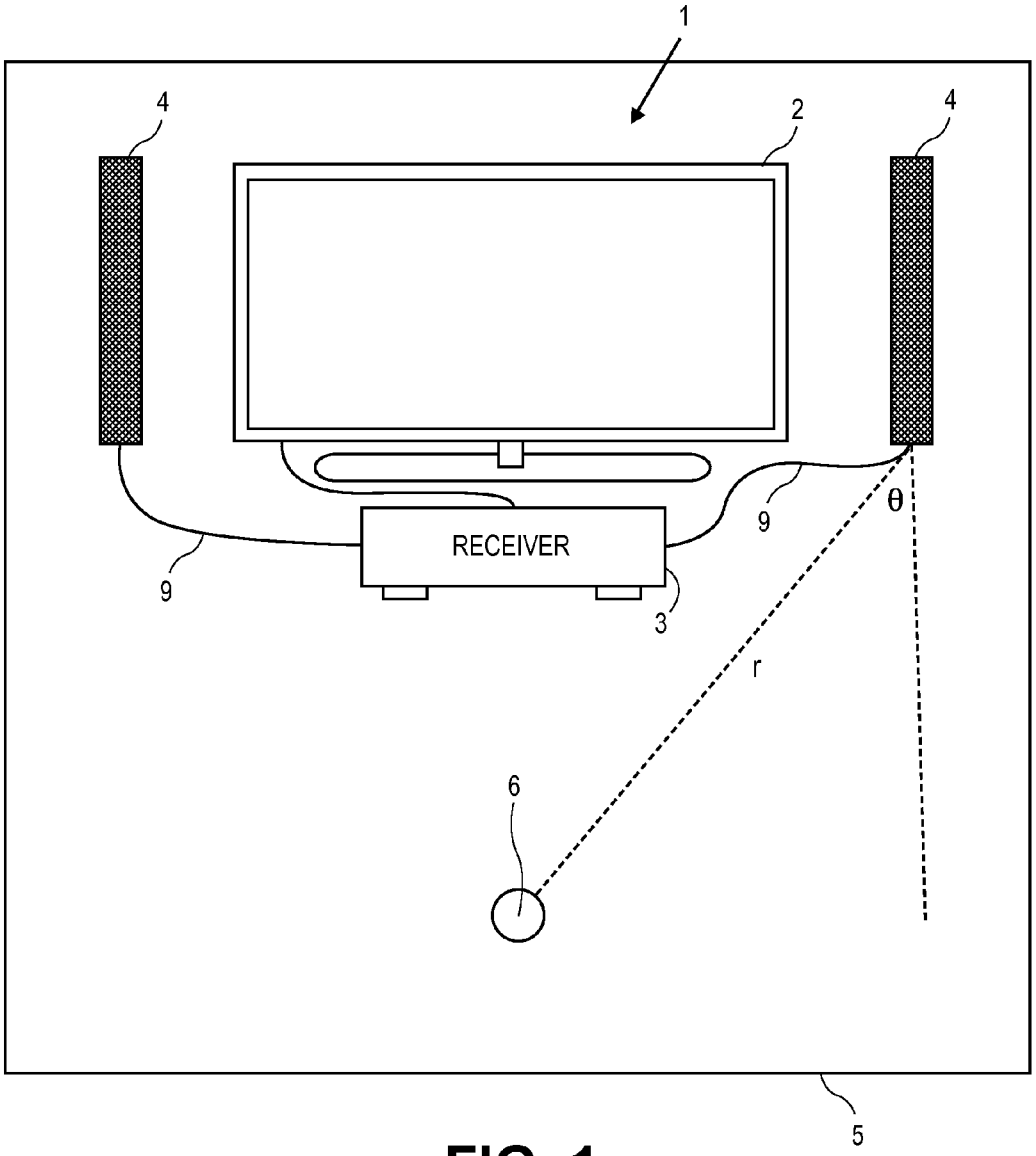
FIG. 1 shows a home audio system that includes an external audio source, an audio receiver, and one or more loudspeaker arrays.

FIG. 1 shows a home audio system 1 that includes an external audio source 2, an audio receiver 3, and one or more loudspeaker arrays 4. The home audio system 1 outputs sound program content into a room 5 in which an intended listener is located. The listener is traditionally seated at a target location 6 at which the home audio system 1 is primarily directed or aimed. The target location 6 is typically in the center of the room 5, but may be in any designated area of the room 5. By adjusting directivity properties of the loudspeaker arrays 4 relative to the target location 6 and responsive to the characteristics of the room 5 and sound program content, the audio receiver 3 drives the loudspeaker arrays 4 to more accurately represent the position and depth of the sound program content to the listener. Each of the elements of the home audio system 1 will be described by way of example below.

Figure 2:
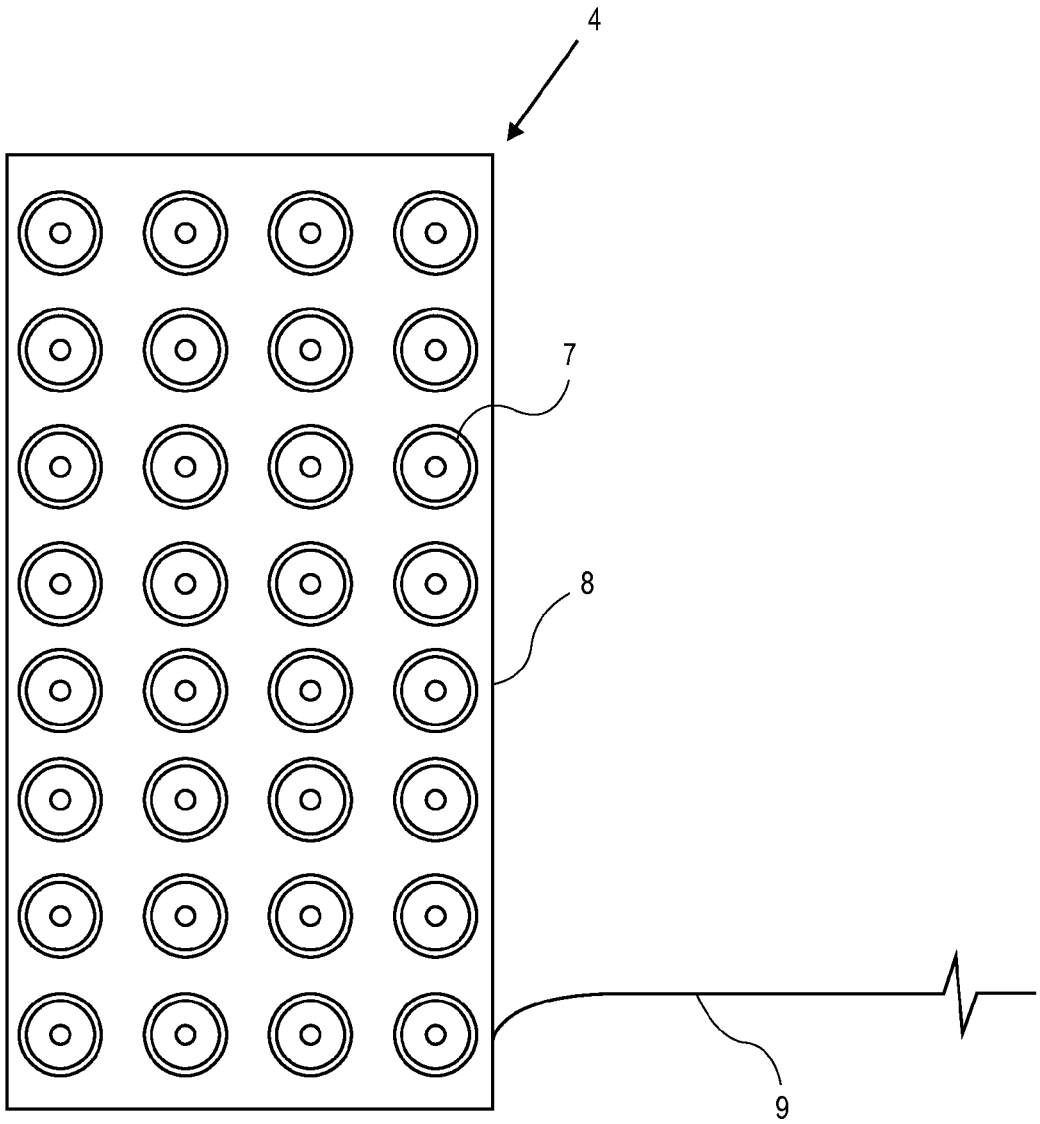
FIG. 2 shows one loudspeaker array with multiple transducers housed in a single cabinet.

FIG. 2 shows one loudspeaker array 4 with multiple transducers 7 housed in a single cabinet 8. In this example, the loudspeaker array 4 has 32 distinct transducers 7 evenly aligned in eight rows within the cabinet 8. In other embodiments, different numbers of transducers 7 may be used with uniform or non-uniform spacing. The transducers 7 may be any combination of full-range drivers, mid-range drivers, subwoofers, woofers, and tweeters. Each of the transducers 7 may use a lightweight diaphragm, or cone, connected to a rigid basket, or frame, via a flexible suspension that constrains a coil of wire (e.g. a voice coil) to move axially through a cylindrical magnetic gap. When an electrical audio signal is applied to the voice coil, a magnetic field is created by the electric current in the voice coil, making it a variable electromagnet. The coil and the transducers' 7 magnetic system interact, generating a mechanical force that causes the coil (and thus, the attached cone) to move back and forth, thereby reproducing sound under the control of the applied electrical audio signal coming from a source, such as the audio receiver 3. Although described herein as having multiple transducers 7 housed in a single cabinet 8, in other embodiments the loudspeaker arrays 4 may include a single transducer 7 housed in the cabinet 8. In these embodiments, the loudspeaker array 4 is a standalone loudspeaker.

Each transducer 7 may be individually and separately driven to produce sound in response to separate and discrete audio signals. By allowing the transducers 7 in the loudspeaker array 4 to be individually and separately driven according to different parameters and settings (including delays and energy levels), the loudspeaker arrays 4 may produce numerous directivity patterns to simulate or better represent respective channels of the sound program content played in the room 5 by the home audio system 1.

In one embodiment, each loudspeaker array 4 may accept input from each audio channel of the sound program content output by the audio receiver 3 and produce different corresponding beams of audio into the room 5. For example, if a surround channel of the sound program content is supplied by an output of the receiver 3 to a left loudspeaker array, in the instance of having no surround loudspeaker, the beam that is formed by the left loudspeaker array may have a null pointed towards the target location 6 (e.g. a listener), and radiation throughout the rest of the room/space 5. In this way, the left loudspeaker array has a negative directivity index for surround content.

As shown in FIG. 1, the loudspeaker arrays 4 are coupled to the audio receiver 3 through the use of wires or conduit 9. For example, each loudspeaker array 4 may include two wiring points and the receiver 3 may include complementary wiring points. The wiring points may be binding posts or spring clips on the back of the loudspeaker arrays 4 and the receiver 3, respectively. The wires 9 are separately wrapped around or are otherwise coupled to respective wiring points to electrically couple the loudspeaker arrays 4 to the audio receiver 3.

In other embodiments, the loudspeaker arrays 4 are coupled to the audio receiver 3 using wireless protocols such that the arrays 4 and the audio receiver 3 are not physically joined but maintain a radio-frequency connection. For example, the loudspeaker arrays 4 may include a WiFi receiver for receiving audio signals from a corresponding WiFi transmitter in the audio receiver 3. In some embodiments, the loudspeaker arrays 4 may include integrated amplifiers for driving the transducers 7 using the wireless audio signals received from the audio receiver 3.

FIG. 1 shows two loudspeaker arrays 4 in the home audio system 1 located at front right and left positions in relation to the target location 7. Using continually and automatically adjusted directivity parameters, the front right and left loudspeaker arrays 4 may collectively represent left, right, and center front channels and left and right surround channels of the sound program content. In other embodiments, different numbers and positions of loudspeaker arrays 4 may be used. For example, in one embodiment five loudspeaker arrays 4 may be used in which three loudspeaker arrays 4 are placed in front left, right and center positions and two loudspeaker arrays 4 are placed in rear left and right positions. In this embodiment, the front loudspeaker arrays 4 represent respective left, right, and center channels of the sound program content and the rear left and right channels represent respective left and right surround channels of the sound program content.

Figure 3:
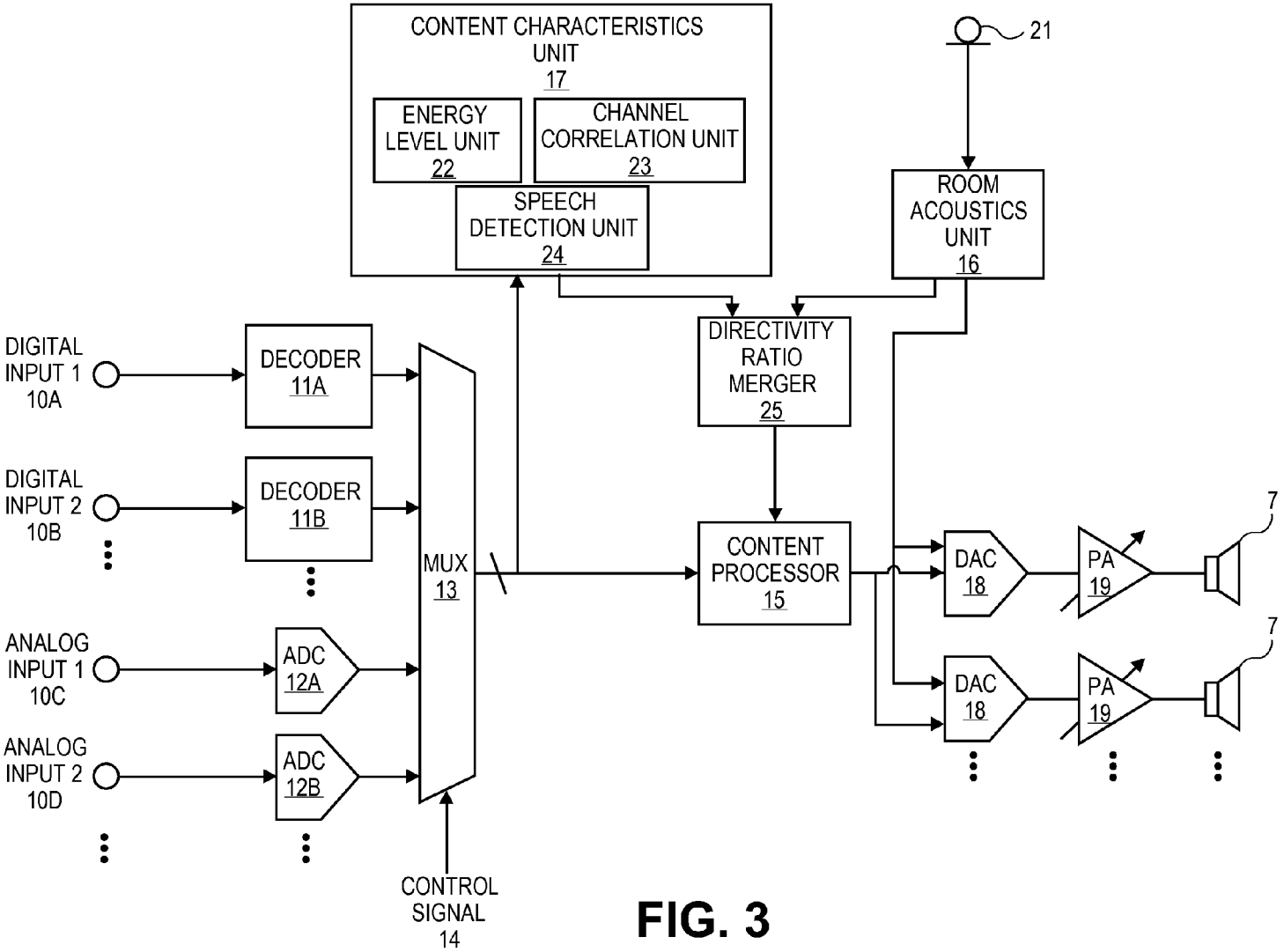
FIG. 3 shows a functional unit block diagram and some constituent hardware components of the audio receiver.

The loudspeaker arrays 4 receive one or more audio signals for driving each of the transducers 7 from the audio receiver 3. FIG. 3 shows a functional unit block diagram and some constituent hardware components of the audio receiver 3. Although not shown, the receiver 3 has a housing in which the components shown in FIG. 3 reside.

It is understood that the functions and operations of the audio receiver 3 may be performed by other standalone electronic devices. For example, the audio receiver 3 may be implemented by a general purpose computer, a mobile communications device, or a television. In this manner, the use of the term audio receiver 3 is not intended to limit the scope of the home audio system 1 described herein.

The audio receiver 3 is used to play sound program content through the loudspeaker arrays 4. The sound program content may be delivered or contained in a stream of audio that may be encoded or represented in any known form. For example, the sound program content may be in an Advanced Audio Coding (AAC) music file stored on a computer or DTS High Definition Master Audio stored on a Blu-ray Disc. The sound program content may be in multiple channels or streams of audio.

The receiver 3 includes multiple inputs 10 for receiving the sound program content using electrical, radio, or optical signals from one or more external audio sources 2. The inputs 10 may be a set of digital inputs 10A and 10B and analog inputs 10C and 10D including a set of physical connectors located on an exposed surface of the receiver 3. For example, the inputs 10 may include a High-Definition Multimedia Interface (HDMI) input, an optical digital input (Toslink), a coaxial digital input, and a phono input. In one embodiment, the receiver 3 receives audio signals through a wireless connection with an external audio source 2. In this embodiment, the inputs 10 include a wireless adapter for communicating with the external audio source 2 using wireless protocols. For example, the wireless adapter may be capable of communicating using Bluetooth, IEEE 802.11x, cellular Global System for Mobile Communications (GSM), cellular Code division multiple access (CDMA), or Long Term Evolution (LTE).

As shown in FIG. 1, the external audio source 2 may include a television. In other embodiments, the external audio source 2 may be any device capable of transmitting the sound program content to the audio receiver 3 over a wireless or wired connection. For example, the external audio source 2 may include a desktop or laptop computer, a portable communications device (e.g. a mobile phone or tablet computer), a streaming Internet music server, a digital-video-disc player, a Blu-ray Disc™ player, a compact-disc player, or any other similar audio output device.

In one embodiment, the external audio source 2 and the audio receiver 3 are integrated in one indivisible unit. In this embodiment, the loudspeaker arrays 4 may also be integrated into the same unit. For example, the external audio source 2 and audio receiver 3 may be in one television or home entertainment unit with loudspeaker arrays 4 integrated in left and right sides of the unit.

Returning to the audio receiver 3, each of the elements shown in FIG. 3 including general signal flow will now be described. Looking first at the digital inputs 10A and 10B, upon receiving a digital audio signal through an input 10A and 10B, the receiver 3 uses a decoder 11A or 11B to decode the electrical, optical, or radio signals into a set of audio channels representing the sound program content. For example, the decoder 11 may receive a single signal containing six audio channels (e.g. a 5.1 signal) and decode the signal into six audio channels. The decoder 11 may be capable of decoding an audio signal encoded using any codec or technique including Advanced Audio Coding (AAC), MPEG Audio Layer II, MPEG Audio Layer III, and Free Lossless Audio Codec (FLAC).

Turning to the analog inputs 10C and 10D, each analog signal received by analog inputs 10C and 10D represents a single audio channel of the sound program content. Accordingly, multiple analog inputs 10C and 10D may be needed to receive each channel of the sound program content. The audio channels may be digitized by respective analog-to-digital converters 12A and 12B to form digital audio channels.

The digital audio channels from each of the decoders 11A and 11B and the analog-to-digital converters 12A and 12B are output to the multiplexer 13. The multiplexer 13 selectively outputs a set of audio channels based on a control signal 14. The control signal 14 may be received from a control circuit or processor in the audio receiver 3 or from an external device. For example, a control circuit controlling a mode of operation of the audio receiver 3 may output the control signal 14 to the multiplexer 13 for selectively outputting a set of digital audio channels.

The multiplexer 13 feeds the selected digital audio channels to a content processor 15. The channels output by the multiplexer 13 are processed by the content processor 15 to produce a set of processed audio channels. The processing may operate in both the time and frequency domains using transforms such as the Fast Fourier Transform (FFT), for example. The content processor 15 may be a special purpose processor such as application-specific integrated circuit (ASICs), a general purpose microprocessor, a field-programmable gate array (FPGA), a digital signal controller, or a set of hardware logic structures (e.g. filters, arithmetic logic units, and dedicated state machines).

The content processor 15 may perform various audio processing routines on the digital audio channels to adjust and enhance the sound program content in the channels. The audio processing may include directivity adjustment, noise reduction, equalization, and filtering.

In one embodiment, the content processor 15 adjusts the directivity of the audio channels to be played through the loudspeaker arrays 4 according to acoustic properties of the room 5 in which the loudspeaker arrays 4 are located, as well as the audio characteristics of the sound program content to be played through the loudspeaker arrays 4. Adjusting the directivity of the audio channels may include assigning a directivity ratio to one or more segments of the channels. As will be discussed in more detail below, these directivity ratios are used for selecting a set of transducers 7 and corresponding delays and energy levels for playing respective segments of each channel.

In one embodiment, the receiver 3 includes a room acoustics unit 16 for measuring the acoustic properties of the room 5 using acoustic reverberation testing and early reflection detection, and a content characteristics unit 17 for continually measuring the audio characteristics of the sound program content. The room acoustics unit 16 and the content characteristics unit 17 will be described in more detail below.

As noted above, the room acoustics unit 16 measures the acoustic properties of the room 5. The acoustics properties of the room 5 include the reverberation time of the room 5 and its corresponding change with frequency amongst other properties. Reverberation time may be defined as the time in seconds for the average sound in a room to decrease by 60 decibels after a source stops generating sound. Reverberation time is affected by the size of the room 5 and the amount of reflective or absorptive surfaces within the room 5. A room with highly absorptive surfaces will absorb the sound and stop it from reflecting back into the room. This would yield a room with a short reverberation time. Reflective surfaces will reflect sound and will increase the reverberation time within a room. In general, larger rooms have longer reverberation times than smaller rooms. Therefore, a larger room will typically require more absorption to achieve the same reverberation time as a smaller room.

In one embodiment, among other properties of room acoustics, early reflections may be detected by the receiver as to level, time, direction, and spectrum. The directivity of the loudspeaker arrays may then be controlled to reduce the level in particular of specific reflections, reducing them below a criteria level, such as −15 dB for 15 ms.

In one embodiment, the room acoustics unit 16 generates a series of audio samples that are output into the room 5 by one or more of the loudspeaker arrays 4. In one embodiment, as shown in FIG. 3, the room acoustics unit 16 transmits the audio samples to the digital-to-analog converters 18. The analog signals generated by the digital-to-analog converters 18 are transmitted to the power amplifiers 19 to drive the loudspeaker arrays 4 attached to the outputs 20. A microphone 21 coupled to the receiver 3 senses the sounds produced by the loudspeaker arrays 4 as they reflect and reverberate through the room 5. The microphone 21 feeds the sensed sounds to the room acoustics unit 16 for processing. The microphone 21 may produce a digital signal that is fed directly into the room acoustics unit 16 or it may output an analog signal that requires conversion by a digital-to-analog converter before being fed into the room acoustics unit 16.

As described above, the room acoustics unit 16 analyzes the sensed sounds from the microphone 21 and calculates the reverberation time of the room 5 by, for example, determining the time in seconds for the average sound in the room 5 to decrease by 60 decibels after the loudspeaker arrays 4 stop generating sound. In some embodiments, the reverberation time of the room 5 may be calculated as an average time or other linear combination, based on multiple reverberation time calculations.

Based on the measured acoustic properties of the room 5, including the determined reverberation time of the room 5, the room acoustics unit 16 generates a directivity ratio for the room 5. The directivity ratio represents the sound intensity $I_q$ at a distance r and angle θ from the loudspeaker arrays 4 and I is the average sound intensity over the spherical surface produced by the loudspeaker arrays 4 at the distance r. This may be represented as:

$$D_R = 10 \log_{10}\left(\frac{I_q}{I}\right)$$

Where $D_R$ is the room directivity ratio and the distance r and angle θ are in relation to the target location 6 in the room 5. In one embodiment, the room directivity ratio is proportional to the reverberation time of the room 5 such that as the reverberation time increases from one room to another or for the same room after changes to the room layout have occurred the directivity ratio increases by a proportional amount.

In one embodiment, the room acoustics unit 16 calculates the reverberation time and corresponding room directivity ratio periodically and without direction from a user. For example, the audio samples emitted into the room 5 to calculate the reverberation time may be periodically combined with the sound program content played by audio receiver 3 through the loudspeaker arrays 4. In this embodiment, the audio samples are not audible to listeners but are capable of being picked up by the microphone 21. For example, the audio samples may be masked by being hidden underneath the sound program content, occupying the same frequency band, but lying beneath the sound program content so as to remain inaudible. In one embodiment, the loudspeaker arrays 4 may be used simultaneously with the sound program content and with an ultrasonic probe signal.

As described above, the room acoustics unit 16 measures the acoustic properties of the room 5 over a period of time. These individual measurements may be used to calculate a long-term running average of the acoustic properties of the room 5. In this fashion, the relatively constant and unchanging nature of the acoustics in the room 5 may be more accurately computed by utilizing a wider number of measurements. In contrast, as described in further detail below, the content characteristics unit 17 measures the constantly changing audio characteristics of the sound program content over shorter periods of time.

In one embodiment, the detection of level, timing, direction and spectrum may be used to steer a beam from the loudspeaker array in such a manner as to reduce the effects of audible reflections, by staying below a threshold value, such as −15 dB spectrum level at times less than 15 ms after the direct sound has passed the listener location.

Turning to the content characteristics unit 17, this unit analyzes the sound program content to measure audio characteristics of the sound program content and calculate a corresponding content directivity ratio. As shown in FIG. 3, the audio channels representing the sound program content are output by the multiplexer 13 to the content characteristics unit 17 such that each audio channel may be analyzed.

In one embodiment, the content characteristics unit 17 analyzes one segment of an audio channel at a time. These segments may be time divisions or frequency divisions of a channel, of course, shorter or longer time segments are also possible. For example, a channel may be divided into three-second segments. These distinct time segments are analyzed individually by the content characteristics unit 17 and a separate content directivity ratio is calculated for each time segment. In another example, the sound program content may be analyzed in non-overlapping 100 Hz frequency divisions, of course narrower or wider frequency segments are also possible. This frequency division, as will be described in further detail below, may be in addition to a time division such that each frequency division in a time division is individually analyzed and a separate content directivity ratio is calculated.

The audio characteristics measured by the content characteristics unit 17 may include various features of the sound program content to be played by the audio receiver 3 through the loudspeaker arrays 4. The audio characteristics may include an energy level of a segment, a correlation level between respective segments, and speech detection in a segment. To calculate and detect these audio characteristics, the content characteristics unit 17 may include an energy level unit 22, a channel correlation unit 23, and a speech detection unit 24. Each of these audio characteristic units will be described below.

Figure 4:
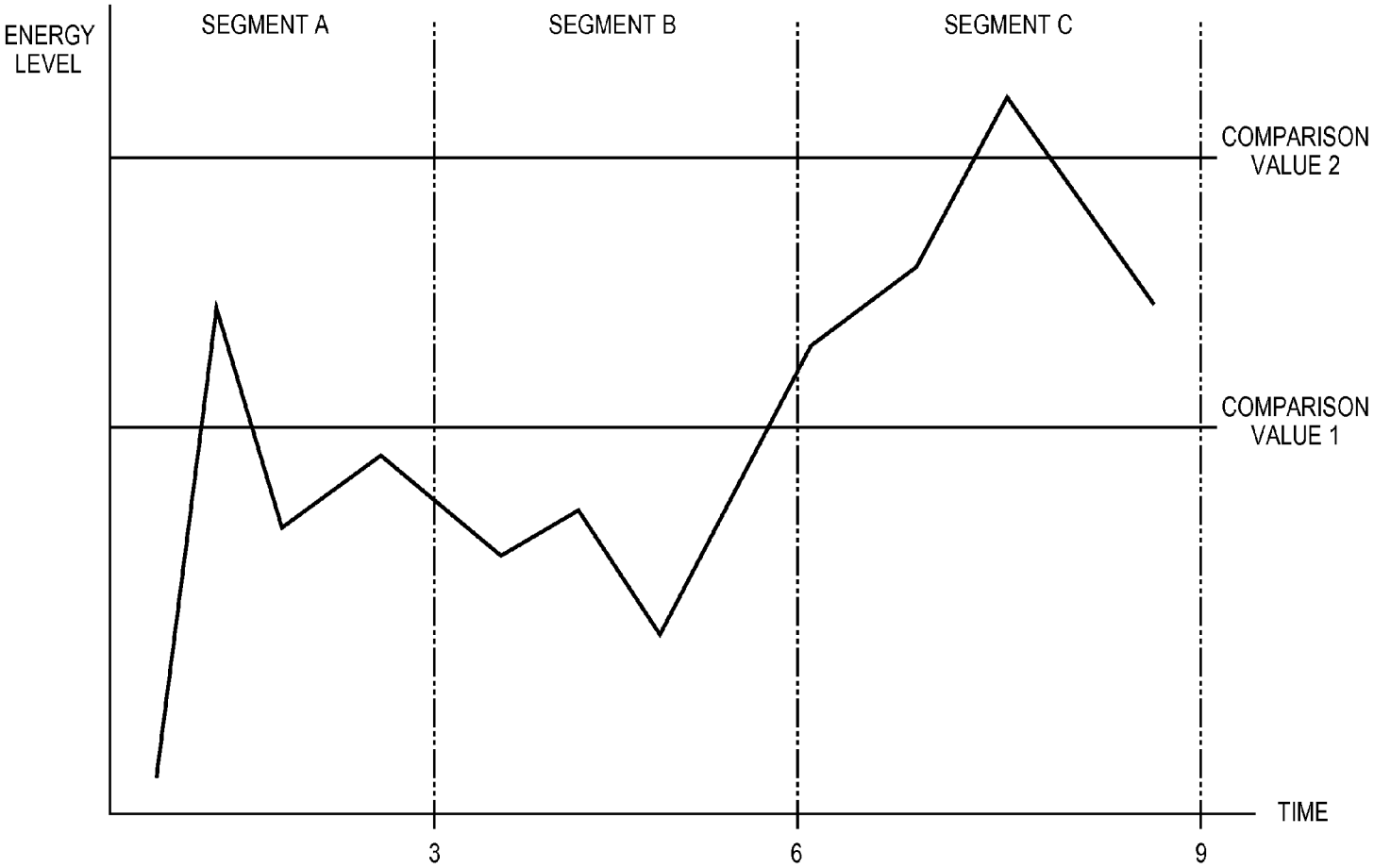
FIG. 4 shows a chart of the energy levels for several segments of an example audio channel.

The energy level unit 22 measures the energy level in a segment of a channel and assigns a corresponding content directivity ratio. A high energy level in a segment may indicate that this segment should be associated with a proportionally high content directivity ratio. FIG. 4 shows a chart of the energy levels for several segments of an example audio channel. In this example, the segments are three-second non-overlapping divisions of an audio channel. The chart in FIG. 4 also shows two energy comparison values. Segments that at any point fall below both energy comparison values are assigned a low content directivity ratio; segments that at any point rise above the first energy comparison value but below the second energy comparison value are assigned a medium content directivity ratio; and segments that at any point rise above both energy comparison values are assigned a high content directivity ratio. The low, medium, and high content directivity ratios may be predefined and may, for example, be equal to 3 decibels, 9 decibels, and 15 decibels, respectively. In the example channel represented in FIG. 4, segment A would be assigned a medium content directivity ratio of 9 decibels as it extends above comparison value 1 but not above comparison value 2; segment B would be assigned a low content directivity ratio of 3 decibels as it never extends above comparison values 1 or 2; and segment B would be assigned a high content directivity ratio of 15 decibels as it extends above both comparison values 1 and 2. In other embodiments, more or less energy comparison values may be used to measure the energy levels of segments of the sound program content.

In one embodiment, the energy level unit 22 measures a ratio/fraction of the energy level in a segment of a channel and the sum of the energies of all the channels of the sound program content. This fraction may thereafter be compared against a series of comparison values in a similar fashion as described above to determine a content directivity ratio.

The channel correlation unit 23 measures a correlation level between a segment in one channel and a corresponding segment in another channel and assigns a content directivity ratio based on the measured correlation value. Correlation is a measure of the strength and direction of the linear relationship between two variables that is defined in terms of the covariance of the variables divided by their standard deviations. The variables in this case are the signals in the various channels in various combinations, especially pairing among the channels. The result of a correlation process lies between 0 and 1, with zero indicating the signals are completely unrelated, to one, indicating the signals are identical. A low correlation between channels in a segment of the sound program content may indicate that the segment should be assigned a proportionally low content directivity ratio.

The speech detection unit 24 detects the presence of speech in a segment and its variation with frequency and assigns a content directivity ratio based on the detection of speech. Detection of speech in a segment may indicate that the segment should include a higher content directivity ratio than that for the average segment of the sound program content. Speech detection or voice activity detection may be performed using any known algorithm or technique. Upon detecting speech in a segment, the speech detection unit 24 assigns a first predefined content directivity ratio to the segment. Upon not detecting speech in a segment, the speech detection unit 24 assigns a second predefined content directivity ratio to the segment that is lower than the first predefined content directivity ratio. For example, a content directivity ratio of 3 decibels may be assigned to a segment that does not contain speech while a content directivity ratio of 15 decibels is assigned to a segment of the sound program content that does contain speech.

In one embodiment, the content directivity ratios assigned to segments containing speech may be varied based on the energy level of other audio characteristics of the segments.

For example, a segment with high energy speech may be assigned a content directivity ratio of 18 decibels while a segment with low energy speech may be assigned a content directivity ratio of 12 decibels.

After analyzing the energy level, channel correlation, and detection of speech in a segment of the sound program content, an overall content directivity ratio may be calculated by the content characteristics unit 17. In one embodiment, the overall content directivity ratio is a strict average of the individually calculated content directivity ratios. In other embodiments, the overall content directivity ratio is a weighted average of the individually calculated content directivity ratios. In a weighted average each individually calculated content directivity ratio is assigned a weight from 0.1 to 1.0 based on importance. The weighted average content directivity ratio $D_W$ may be calculated based on the following:

$$D_W = \frac{\alpha D_E + \beta D_C + \gamma D_S}{3}$$

Where $D_E$ is the calculated energy content directivity ratio, $D_C$ is the calculated correlation content directivity ratio, $D_S$ is the calculated speech content directivity ratio, and α, β, and γ are respective weights.

As described above, segments of the sound program may include frequency divisions in addition to time divisions. For example, a three-second time segment may also be divided into 100 Hz frequency bins or spectral components. Under this approach, each spectral component is assigned a separate content directivity ratio $D_F$ that is derived from the originally calculated $D_W$. This may be represented by:

$$D_F = \delta D_W$$

In this equation, scaling factor δ is a positive real number that is predefined for each spectral component F. For example, Table 1 below may represent the values for scaling factor δ for each spectral component.

TABLE 1

| Spectral Component or Frequency Bin (Hz) | δ |
|---|---|
| 1-100 | 0.4 |
| 101-200 | 0.5 |
| 201-500 | 0.7 |
| 501-1,000 | 1.0 |
| 1,001-2,000 | 1.3 |
| 2,001-5,000 | 1.6 |
| 5,001-10,000 | 2.0 |

Under this approach, higher frequencies are assigned a higher directivity ratio while low frequencies are assigned lower directivity ratios. The scaling factors and spectral components shown in Table 1 are merely examples and different values may be used in alternate embodiments.

Following the computation of the content directivity ratio ($D_F$ and/or $D_W$) and the computation of the room directivity ratio $D_R$, both directivity ratios are fed into a directivity ratio merger 25. The directivity ratio merger 25 combines the content directivity ratio and the room directivity ratio to produce a merged directivity ratio for a segment of one channel of the sound program content. This merged directivity ratio takes into account the acoustic properties of the room in which the loudspeaker arrays are located, as well as the audio characteristics of the segment of the sound program content to be played through the loudspeaker arrays. In one embodiment, the merged directivity ratio is calculated as a weighted average of the content directivity ratio ($D_F$ or $D_W$) and the room directivity ratio $D_R$. This may be represented by:

$$D_M = \frac{\alpha(D_F \mid D_W) + \gamma D_R}{2}$$

Where $D_M$ is the merged directivity ratio, $D_F$ or $D_W$ are the content directivity ratio, $D_R$ is the room directivity ratio, and α and γ are respective weights.

The merged directivity ratio is passed to the content processor 15 for processing the segment of the sound program content and then the segment may be output by one or more transducers of the loudspeaker arrays 4 to form a directivity pattern that more accurately represents the position and depth of the sound program content to the listener.

In one embodiment, the content processor 15 decides which transducers in one or more loudspeaker arrays 4 output the segment based on the merged directivity ratio. In this embodiment, the content processor 15 may also determine delay and energy settings used to output the segment through the selected transducers. Additionally, the delay, spectrum, and energy may be controlled to reduce the effects of early reflections. The selection and control of a set of transducers, delays, and energy levels allows the segment to be output according to the merged directivity ratio that takes into account both the room acoustics and the audio characteristics of the sound program content.

As shown in FIG. 3, the processed segment of the sound program content is passed from the content processor 15 to one or more digital-to-analog converters 18 to produce one or more distinct analog signals. The analog signals produced by the digital-to-analog converters 18 are fed to the power amplifiers 19 to drive selected transducers of the loudspeaker arrays 4.

The measuring test signal may be a set of test tones injected into the loudspeaker arrays and measured at the listening location(s), or at the other loudspeaker arrays, or it may be by use of measuring devices using the program material itself for measurement purposes, or it may be a masked signal placed inaudibly within the program content.

As explained above, an embodiment of the invention may be an article of manufacture in which a machine-readable medium (such as microelectronic memory) has stored thereon instructions which program one or more data processing components (generically referred to here as a "processor") to perform the operations described above. In other embodiments, some of these operations might be performed by specific hardware components that contain hardwired logic (e.g., dedicated digital filter blocks and state machines). Those operations might alternatively be performed by any combination of programmed data processing components and fixed hardwired circuit components.

While certain embodiments have been described and shown in the accompanying drawings, it is to be understood that such embodiments are merely illustrative of and not restrictive on the broad invention, and that the invention is not limited to the specific constructions and arrangements shown and described, since various other modifications may occur to those of ordinary skill in the art. The description is thus to be regarded as illustrative instead of limiting.

What is claimed is:

1. A method for adjusting sound directional properties of a loudspeaker array, comprising:

measuring, by a processor, acoustic properties of a room containing the loudspeaker array;

determining a first sound directional property for processing to produce a directional pattern from the loudspeaker array according to the measured acoustic properties of the room;

measuring, repeatedly by the processor over the playing time of sound program content to be emitted by the loudspeaker array, audio characteristics of a plurality of audio channels of the sound program content that comprise energy level of a segment of the sound program content, correlation level between two channels in a segment of the sound program content, and detection of speech in a segment of the sound program content;

determining, repeatedly by the processor over the playing time of the sound program content, a second sound directional property for processing to produce a directional pattern from the loudspeaker array according to the measured audio characteristics of the sound program content; and playing, through the loudspeaker array, the sound program content processed to produce a directional pattern according to the first and second sound directional properties.

2. The method of claim 1, wherein the first and second sound directional properties each include a ratio of sound directed by the loudspeaker array directly at an intended listener location to the total amount of sound directed by the loudspeaker array into the room.

3. The method of claim 1, wherein the acoustic properties are measured based on discrete reflections of sound from the loudspeaker array off surfaces and objects in the room.

4. The method of claim 3, wherein the acoustic properties that are measured based on discrete reflections of sound from the loudspeaker array are used to steer sound output of the array so as to reduce a level of early reflections below a threshold level.

5. The method of claim 2, wherein the acoustic properties include the reverberation time of the room.

6. The method of claim 5, wherein the ratio corresponding to the first sound directional property is proportional to the reverberation time of the room.

7. The method of claim 2, wherein measuring the audio characteristics of the sound program content comprises:

computing a ratio of i) the energy level of a channel of the sound program content and ii) the sum of the energies of all the channels of the sound program content, for each channel.

8. The method of claim 7, wherein determining the second sound directional property of the sound program content comprises:

increasing the ratio included in the second sound directional property in response to (1) detecting an energy level in a current segment of the sound program content is higher than a predefined energy level or (2) detecting that the computed ratio of the energy level of a channel of the sound program content and the sum of the energies of all the channels of the sound program content, in each channel, is higher than a predefined value;

increasing the ratio included in the second sound directional property in response to detecting that the correlation level between the first and second channels in the current segment of the sound program content is higher than a predefined correlation level; and adjusting the ratio included in the second sound directional property in response to detecting speech in the current segment of the sound program content.

9. The method of claim 8, wherein the predefined energy level and the predefined correlation level correspond to the energy and correlation levels in a previous segment of the sound program content that precedes the current segment.

10. The method of claim 2, wherein non-overlapping frequency divisions of the sound program content are represented by separate ratios included in the second sound directional property, wherein determining the second sound directional property of the sound program content further comprises:

increasing the separate ratios for higher frequency divisions; and decreasing the separate ratios for lower frequency divisions.

11. The method of claim 7, wherein the loudspeaker array plays the sound program content from the first and second channels, simultaneously outputting the first and second channels with individual first and second directional properties for each channel.

12. An audio receiver for driving a loudspeaker, comprising:

a room acoustics unit for measuring acoustic properties of a room and determining a first sound directional property for processing to produce a directional pattern from the loudspeaker according to the measured acoustic properties of the room;

a content characteristics unit for measuring audio characteristics of a segment of sound program content and determining a second sound directional property for processing to produce a directional pattern from the loudspeaker according to the measured audio characteristics of the segment of the sound program content wherein the content characteristics unit comprises an energy level unit for measuring energy level of the segment of the sound program content, a correlation level unit for measuring a correlation level between first and second source channels in the segment of the sound program content, wherein the segment of the sound program content is a segment about to be played through the loudspeaker, and a speech detector for detecting speech in the segment of the sound program content, wherein the energy level, the correlation level, and the detection of speech are included in the audio characteristics; and a driver unit for playing the segment of the sound program content through the loudspeaker processed to produce a directional pattern according to the first and second directional properties.

13. The audio receiver of claim 12, wherein the room acoustics unit and the content characteristics unit are to determine the first and second sound directional properties as including first and second directional ratios, respectively, which are ratios of sound directed by the loudspeaker at a target in the room to the total amount of sound directed by the loudspeaker into the room.

14. The audio receiver of claim 12, wherein the room acoustics unit is to determine the first sound directional property as including a first directional ratio which is proportional to the reverberation time of the room.

15. The audio receiver of claim 12, wherein the room acoustics unit detects early reflections in the room and the driver unit outputs a directional beam to reduce the effect of the early reflections.

16. The audio receiver of claim 15, wherein the directional beam is steered so as to avoid early reflections above a criteria level.

17. The audio receiver of claim 12, wherein the room acoustics unit measures the acoustic properties of the room prior to playing the sound program content through the loudspeaker, and wherein the content characteristics unit measures the audio characteristics of the segment prior to playing the segment through the loudspeaker.

18. An apparatus for sound directionality adjustment, comprising:

an article of manufacture having a machine-readable storage medium that stores instructions which, when executed by a computing device, cause the computing device to measure acoustic properties of a room containing a loudspeaker array, determine a first directional property for processing to produce a directional pattern from the loudspeaker array according to the measured acoustic properties, measure, repeatedly over the playing time of sound program content to be emitted by the loudspeaker array, audio characteristics of the sound program content as an energy level of a current segment of the sound program content, a correlation level between first and second source channels in the current segment of the sound program content, and detected speech in the current segment of the sound program content, wherein the current segment of the sound program content is a segment about to be played through the loudspeaker array, and determine, repeatedly over the playing time of the sound program content, a second directional property for processing to produce a directional pattern from the loudspeaker array according to the measured audio characteristics of the sound program content.

19. The apparatus of claim 18, wherein the first and second directional properties each include a ratio of sound directed by the loudspeaker array directly at an intended listener location to the total amount of sound directed by the loudspeaker array into the room.

20. The apparatus of claim 19, wherein the ratio corresponding to the first directional property is proportional to the reverberation time of the room.

21. The apparatus of claim 19, wherein the instructions to determine the second directional property of the sound program content comprise instructions that when executed by the computing device:

adjust the ratio included in the second directional property in response to detecting i) an energy level in the current segment of the audio program content is higher than a predefined energy level or ii) a ratio of the energy of each channel of the sound program content and the sum of the energies of all the channels of the sound program content is higher than a predefined value;

adjust the ratio included in the second directional property in response to detecting that a correlation level between the first and second source channels in the current segment of the audio program content is higher than the predefined correlation level; and adjust the ratio included in the second directional property in response to detecting speech in the current segment of the audio program content.

22. The apparatus of claim 19, wherein non-overlapping frequency divisions of the sound program content are represented by separate ratios included in the second directional property, wherein instructions to determine the second directional property of the sound program content further comprise instructions that when executed by the computing device:

increase the separate ratios for higher frequency divisions; and decrease the separate ratios for lower frequency divisions.

23. The apparatus of claim 21, which includes further instructions which, when executed by the processor in the computing device:

play, through the loudspeaker array, the sound program content according to the first and second directional properties, wherein the loudspeaker array plays the sound program content from the first and second source channels, simultaneously outputting the first and second source channels with individual first and second directional properties for each channel.

* * * * *